US005670467A

United States Patent [19]

Fleisher

[11] Patent Number: 5,670,467

[45] Date of Patent: Sep. 23, 1997

[54] STRATIFIED SOLID CAST DETERGENT COMPOSITIONS

[76] Inventor: Howard Fleisher, 124 Sand Hill Rd., Monmouth Junction, N.J. 08852

[21] Appl. No.: 424,919

[22] Filed: Apr. 19, 1995

Related U.S. Application Data

[63] Continuation of Ser. No. 115,070, Sep. 2, 1993, Pat. No. 5,482,641.

[51] Int. Cl.[6] ..... C11D 17/02; C11D 7/06; C11D 7/10; C11D 7/60

[52] U.S. Cl. ..... 510/224; 510/225; 510/229; 510/230; 510/231; 510/232; 510/233; 510/438; 510/439; 510/440

[58] Field of Search ..... 252/174, 174.14, 252/156, 135, 90; 510/224, 225, 229, 230, 231, 232, 233, 438, 439, 440

[56] References Cited

U.S. PATENT DOCUMENTS

| | | | |
|---|---|---|---|
| Re. 32,763 | 10/1988 | Fernholtz et al. | 252/90 |
| Re. 32,818 | 1/1989 | Fernholtz et al. | 252/90 |
| 3,407,144 | 10/1968 | Bath | 252/174 |
| 4,256,599 | 3/1981 | Krisp et al. | 252/99 |
| 4,460,490 | 7/1984 | Barford et al. | 252/92 |
| 4,578,207 | 3/1986 | Holdt et al. | 252/134 |
| 4,595,520 | 6/1986 | Heile et al. | 252/160 |
| 4,680,134 | 7/1987 | Heile et al. | 252/160 |
| 4,683,072 | 7/1987 | Holdt et al. | 252/102 |
| 4,725,376 | 2/1988 | Copeland | 252/90 |
| 4,729,845 | 3/1988 | Altenschoepfer et al. | 252/99 |
| 4,823,441 | 4/1989 | Cotter et al. | 23/313 R |
| 4,828,745 | 5/1989 | Jeschke et al. | 252/99 |
| 4,828,749 | 5/1989 | Kruse et al. | 252/135 |
| 4,897,212 | 1/1990 | Kruse et al. | 252/99 |
| 4,913,832 | 4/1990 | Kruse et al. | 252/99 |
| 4,933,102 | 6/1990 | Olson | 252/174 |
| 5,019,290 | 5/1991 | Bruegge et al. | 252/135 |
| 5,080,819 | 1/1992 | Morganson et al. | 252/90 |
| 5,209,864 | 5/1993 | Perry, Jr. et al. | 252/134 |
| 5,318,713 | 6/1994 | Binter | 252/90 |
| 5,482,641 | 1/1996 | Fleisher | 252/90 |

FOREIGN PATENT DOCUMENTS 0 466 485 1/1992 European Pat. Off. .

OTHER PUBLICATIONS

The American Heritage Dictionary, 2nd College Edition, 1982, pp. 1203–1204, definitions of "stratify" & stratum.

*Primary Examiner*—Ardith Hertzog
*Attorney, Agent, or Firm*—Kenyon & Kenyon

[57] ABSTRACT

Stratified solid cast alkaline detergent compositions are disclosed in which the concentrations of an active alkalinity source and water of hydration which contain at least one granular material in varying concentration throughout the composition. Methods of making and using the disclosed compositions are also disclosed.

28 Claims, 3 Drawing Sheets

STRATIFIED SOLID CAST DETERGENT COMPOSITIONS

This application is a continuation of application Ser. No. 08/115,070, filed on Sep. 2, 1993, now U.S. Pat. No. 5,482,641.

FIELD OF THE INVENTION

The present invention relates to detergent compositions, and methods of making them, that are useful for warewashing (i.e., washing of tableware, cutlery, etc.), particularly in large-scale commercial food service operations.

BACKGROUND OF THE INVENTION

Traditionally, food service equipment, tableware, serving utensils and other reusable food service items have been cleaned with solutions of alkaline detergents in a spray washing type machine, typically a dish washing machine or a pan washing machine. The cleaning operation is fairly straightforward and requires adequate water temperature and pressure, in combination with alkaline builders and other detergent ingredients to effectively emulsify the greases and oils and loosen and suspend the soils that are present and to allow them to be freely rinsed away from the tableware with a final rinse.

Presently available solid cast alkaline detergent compositions provide a uniform formulation throughout the life of the product (see for example those disclosed in U.S. Pat. Nos. RE32,818 and 32,763). However, providing a constant concentration of all formulation components can provide significant disadvantages.

Aside from mechanical operating conditions and limitations, including temperature, the greatest detriment to proper adequate cleaning and bright clean, spot-free, film-free results on the tableware has been water hardness. Other aspects of cleaning such as soil load, etc., are usually handled by increasing or varying the balance of alkaline components within the basic formulation. The results gained are not appreciably different with any alkaline component, be it an alkali metal hydroxide, an alkaline silicate or, for that matter in many cases, an alkaline phosphate or carbonate. The detrimental effects of hard water are handled in institutional and commercial warewashing and spray washing operations by either putting a water conditioning system in place before the cleaning operation or formulating the product to contain high levels of water conditioning agents. The most effective of these water conditioning agents are the complex phosphates which offer the benefits of synergistic enhancement of hard surface detergency and water softening.

However, the use of constant and sustained high levels of phosphates has significant disadvantages. For example, (1) high phosphate concentrations have a negative environmental impact; (2) high levels of complex phosphates are expensive components of a detergent formulation; and (3) the high level of phosphate required to effectively control or eliminate a lime/scale buildup are often high enough to unbalance the formula away from the effective cleaning material (i.e., the alkaline builder) toward the low alkalinity complex phosphate which is being used to control water hardness.

In practice, a commercial or institutional warewashing operation using hard water must periodically descale their washing machines with an acidic compound, which dissolves the lime/scale and restores the machine to its original bright finish. All acidic descalers have a corrosive effect on machine parts and/or plumbing. Unfortunately, this method does not eliminate film and buildup which may occur on the actual tableware and be highly noticeable on glass and crystal. To enhance results and offer film removal and reduced streaking on these types or surface, it is not unusual to use extremely high detergent concentrations to over condition the water or to use acidic or conditioning rinse aids which are substantially more costly than the ordinary sheeting agents used to accelerate the drying of tableware in machine washing operations. Furthermore, the washing equipment must be shut down during the deliming/descaling process, resulting in a loss of productive washing time.

It would, therefore, be desirable to provide a warewashing detergent composition that provided adequate detergency while also removing lime and scale from the washing equipment in which it is used. It would also be desirable to provide such a composition that would provide these deliming/descaling benefits without the need to shut down the washing equipment for the cleaning operation.

In many washing applications it may also be advantageous to provide varying degrees of active agents throughout the life of a detergent product. For example, it may be desirable to provide extra cleaning power at the end of product life before the detergent composition is changed in order to assure that alkalinity concentration is not depressed during the changeover process. It would therefore be desirable to provide detergent compositions which provided a heightened level of alkalinity as the product was used.

It may also be advantageous to periodically provide a strong dose of formulation components to provide other benefits. For example, use of high concentrations of silicates have been demonstrated to replenish glaze on the surface of china and other glazed table ware. It would therefore be desirable to provide detergent compositions in which the concentration of silicate is periodically increased to provide this replenishing effect.

It may also be advantageous to reduce the conductivity of the detergent solution produced by use of a solid cast alkaline detergent composition. Reducing the conductivity of late in the product life would cause the washing machine to increase the rate of dissolving the detergent composition, resulting in a higher concentration of active ingredient in the machine washing solution. It would therefore be desirable to provide a solid cast detergent product which would provide this type of variation in conductivity.

These and other advantages are provided by the present invention.

SUMMARY OF THE INVENTION

The present invention provides solid cast alkaline detergent compositions which are stratified (i.e., nonuniform) and provide a reproducible varying concentration of certain formulation components throughout the composition. In use, these detergent compositions provide an increasing or decreasing concentration of one or more formulation components as the product is used.

Stratification of the detergent compositions is achieved by providing the formulation components to be stratified in granular (i.e., larger than about 100 mesh) form. The granular component or components are added to a molten detergent suspension comprising an active alkalinity source and water of hydration, in addition to other formulation components typically found in this type of composition, while maintaining the temperature of the suspension at a level sufficient to provide low viscosity. Because of its granular nature, the granular material will not completely dissolve in the saturated detergent composition and, because of its density relative to the suspension, will stratify to produce a variation in concentration from the top to the bottom of the composition.

Any material suitable for use in a solid cast alkaline detergent composition available in a granular form can be stratified in accordance with the present invention. In preferred embodiments, sodium tripolyphosphate (STPP), caustic, metasilicate, and sodium carbonate are stratified. More than one formulation component can be stratified, such as both STPP and caustic. Components may also be stratified in opposite orientations of the varied concentration gradient. For example, STPP may be stratified from top to bottom of a composition in increasing concentration, while caustic is stratified from bottom to top in increasing concentration.

In certain preferred embodiments, the solid cast detergent compositions of the present invention allow for the automatic, periodic deliming or descaling of both the washing machine and the tableware being washed therein. The solid cast alkaline detergent compositions of the invention are non-uniform in composition and provide an increasing concentration of water conditioning material as the composition is consumed. Thus, as the composition is used, the amount of water conditioning increases to the point where the concentration of conditioning materials is sufficient to delime/descale the washing machine while the composition is in use.

Any granular water conditioning material can be used in practicing the present invention, although complex phosphate materials are preferred. Suitable phosphate materials include, sodium tripolyphosphate (STPP), tetrasodium pyrophosphate (TSPP), sodium hexametaphosphate (SHMP), and sodium trimetaphosphate (STMP), along with their other alkali metal analogs, particularly potassium analogs (such as, for example, potassium tripolyphosphate). STPP is particularly preferred and can be used in any of its commercially available granular forms. Dense granular STPP in its coarsest commercially available forms is particularly preferred.

In certain preferred embodiments, the composition is cast within a jar or similar type disposable container (such as that shown in FIGS. 1 and 2). In such embodiments, the composition is manufactured such that there is a higher concentration of water conditioning material at the bottom of the container than at its top. The container is typically inverted during use, such that the opening in the top of the container is placed over a controlled spray stream of water (as shown in FIG. 3). The water spray impinges on the surface of the detergent composition, dissolving the solid to form a detergent solution. The detergent solution then flows into the wash tank of the machine. The initially dissolved solid contains a significantly smaller amount of water conditioning material than the bottom of the container, which will be the last part dissolved from the inverted container as the stream of water continues to dissolve the composition.

The water conditioner (such as for example, phosphate and/or other suitable materials) level throughout the jar preferably should be adequate to maintain balanced detergency and threshold water conditioning effect even where minimal conditioner concentrations are present. As the product is consumed, the conditioner concentration preferably increases so that during the consumption of the last about 20–25 percent of the container the concentration of conditioner is sufficient to not only condition the water but also to purge, clean and actually descale and delime both the machine and the tableware being washed. The phosphate concentration in the last portions of the composition is preferably high enough to, in most cases, completely eliminate or at the very least significantly reduce any film or scale buildup which may have occurred during the usage of the early part of the composition. The end result is to provide an effective product, minimizing raw material costs and adding the regular, periodic extra phosphate level needed to eliminate any detrimental effects of high water hardness levels without descaling.

Methods are also disclosed for making the compositions of the present invention. The stratification of phosphate content within the compositions is produced by controlling the viscosity of the molten detergent suspension which hardens into the solid cast detergent composition such that the phosphate components can stratify as the composition is cooled. Temperature control is the most important factor in producing the desired stratified effect, although other means for controlling viscosity and the stratification effect can also be used. Physical form, granulation and density of the formulation components can also have significant effects of the stratification of the resulting product.

In certain preferred embodiments, formulation components, including water and an active alkalinity source (such as an alkali metal hydroxide), are mixed. The temperature of the mixture is then adjusted to provide the desired viscosity of the molten detergent suspension. The granular material to be stratified is then added to the suspension. The appropriate viscosity is that which will provide the desired degree of stratification for a specific composition upon cooling. The molten suspension is then allowed to cool and solidify in a useable form (such as, for example, a cast block in a disposable jar).

Although formulation components can be mixed is any suitable order, typically the component to be stratified is added in its granular form as the last component to the molten detergent suspension. This allows greater maintenance of the granular form of the material, reducing dissolution of the material into the suspension. Dissolution of the granular material will, in most instances, result in reduction or elimination of the stratification of the granular material.

In certain preferred embodiments, the molten detergent suspension is also rapidly cooled in order to reduce or minimize degradation of the water conditioning material (such as for example, reversion of complex phosphates) to form degradation products (such as for example, orthophosphate). Reducing degradation of the water conditioning material maintains the water conditioning activity of the compositions.

In composition incorporating complex phosphate as the water conditioning material, it is preferred to prevent a substantial level of orthophosphate from forming the composition. Preferably less than 40% of the complex phosphate is allowed to revert. In certain particularly preferred embodiments the level of reversion is reduced to less than 20% and even less than 10% however, where the degradation product is orthophosphate, the composition may contain an average composition throughout of less than about 50% orthophosphate as a result of reversion of the complex phosphate.

Stratification of components other than STPP can also be accomplished in accordance with the present invention. Active alkalinity content can also be varied throughout a product such that more active alkalinity is provided in the initial stages of use of the composition. For example, in certain preferred embodiments which are cast in jars, the active alkalinity content is higher at the top of the jar (the portion used first) than at the bottom (the portion used last). This variation in active alkalinity content provides many advantages including more aggressive cleaning action at lower concentrations at the start of product use and deliming, defilming and reconditioning at the end of product use. Variation of active alkalinity can be achieved when a variety of active alkalinity sources are used, including alkali metal hydroxides (such as for example sodium hydroxide and potassium hydroxide), silicates (such as for example alkali metal metasilicates), carbonates (such as for example alkali metal carbonates) and simple phosphates (such as for example orthophosphate). In addition, higher active alkalinity levels can be achieved at the end of the jar by stratifying the active alkalinity source (such as for example an alkali metal hydroxide or an alkali metal silicate) in granular form instead of or in addition to the water-conditioning material.

Although any desired level of active alkalinity can be used in compositions of the present invention, preferably the compositions contain about 5% to about 65%, more preferably about 10% to about 50%, average active alkalinity by weight. Both higher alkalinity compositions (such as those containing about 25% to about 50%) and lower alkalinity compositions (such as those containing about 5% to about 25%) may be made in accordance with the present invention.

Compositions of the present invention can also be designed to provide a variation in the conductivity of the washing solution circulated in a machine during use. For example, providing an increased concentration of STPP or decreased concentration NaOH at the end of product life will reduce the conductivity of the solution of dissolved detergent in the machine, resulting in an increased rate of dissolution. This increased dissolution will automatically result in an increased concentration of the composition being dispensed without adjustment of the concentration (conductivity) control, enhancing the composition's benefits with higher concentration.

BRIEF DESCRIPTION OF THE FIGURES

FIG. 2 is a cross-sectional view of the container shown in FIG. 1 taken along line 2—2.

DESCRIPTION OF PREFERRED EMBODIMENTS

Figure 1:
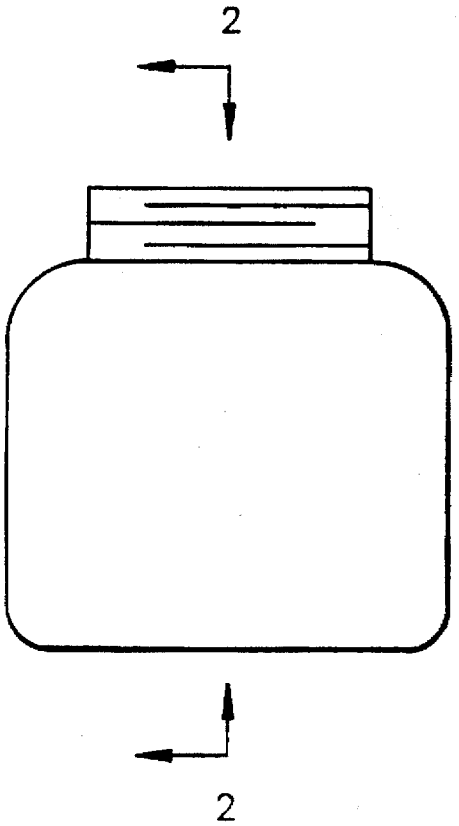
FIGS. 1 and 2 depict a solid cast detergent production of a preferred embodiment of the present invention.
Figure 2:
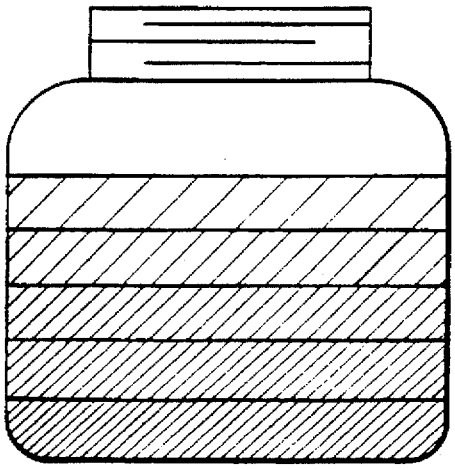
Figure 3:
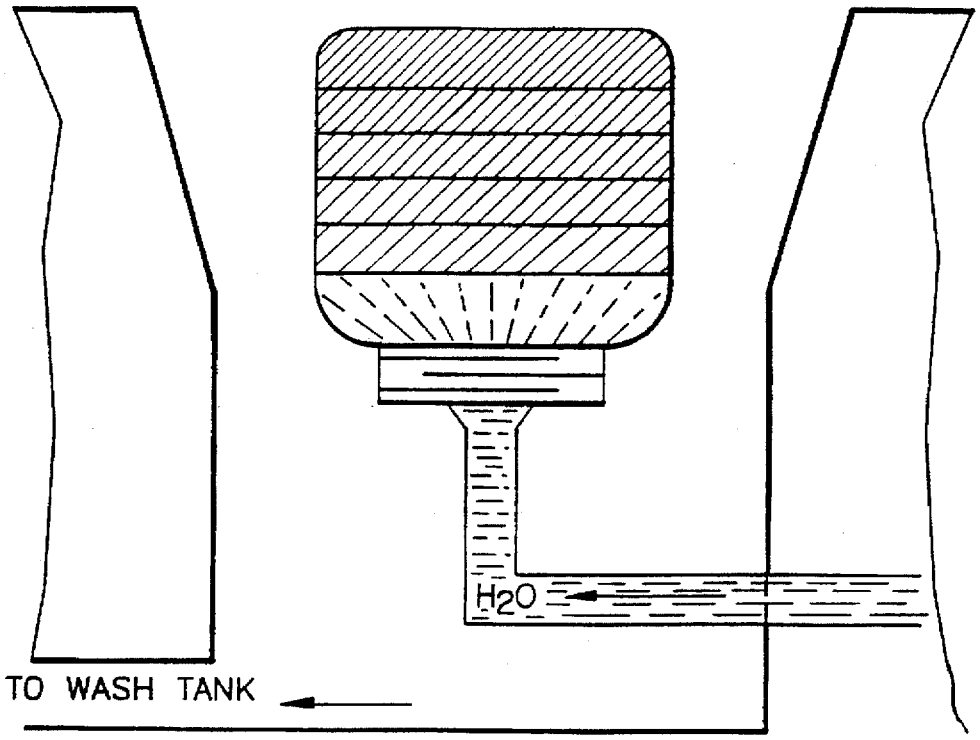
FIG. 3 depicts the preferred embodiment of FIGS. 1 and 2 in position for use in a ware washing machine.

Compositions of the present invention are non-uniform, cast solid alkaline detergent manufactured by heating an aqueous suspension primarily of water and alkaline hydratable materials (such as alkali metal hydroxides, carbonate, silicates and phosphates) together with organic additives of value in a detergent composition (such as surfactants, chelates, organic water conditioning materials, defoamers and a chlorine releasing compound (e.g.,an inorganic hypochlorite or an organic chlorine source)). The components are mixed and temperature adjusted to be just high enough to reduce the viscosity of the suspension to a point where the controlled stratification desired will occur. STPP, the active alkalinity source or other component to be stratified is preferably added last to reduce chemical (such as for example reversion) or physical (such as for example dissolving) degradation which may occur. This temperature will vary based upon the components, their percentage in the product, physical form and density which may be tailored for the optimum desired effect for the product application. Preferably, the temperature is adjusted to from about 130° F. to about 195° F., preferably from about 148° F. to about 163° F., most preferably from about 153° F. to about 158° F. Below 148° F. it may become more difficult to achieve repetitively uniform stratification. Below this temperature some formulations may be more viscous or tend to entrain air resulting in a lower fill weight, which may be desirable under some circumstances. However, the product will still be stratified below this temperature. Temperatures above 163° F. are higher than needed to maintain the reduced viscosity of many formulations. However, these higher temperatures may be required in certain formulations (such as those containing EDTA, carbonate or low density STPP in amounts more than about 10%) to maintain lower viscosity and higher fluidity of the molten detergent suspension during mixing. Prolonged exposure to these higher temperature may also result in deterioration or degradation of some formulation components.

In preferred embodiments, the compositions of the invention are essentially non-uniform (stratified) hydrated alkaline materials which have been cast in the container in which they are meant to be sold, transported and dispensed. The materials are designed to stratify upon standing and solidify as a non-uniform cast solid material. By incorporating components of selected particle size, shape, surface area, density and hydration characteristics, it is possible to create, on a repetitive basis, this unique solid cast composition with highly desirable characteristics. In preferred manufacturing processes the viscosity of the molten detergent material to be reduced to the point where the later sequential addition of some of the components lead to rapid stratification within the container. In the case of complex phosphates, in one preferred embodiment high density granular sodium tripolyphosphate is added as one of the last components to the composition once the molten detergent suspension has reached a relatively low viscosity after the other components have been added. Earlier additions may include other phosphate materials which are not necessarily designed to become part of the highly stratifying component.

The reduction in viscosity of the detergent suspension may be accomplished by any method known to those skilled in the art. Such methods include without limitation (1) adjusting the temperature of the suspension to the point that the material becomes readily flowable, (2) adding dispersing materials (such as lignosulfonates and certain surfactants or organic compounds) which have a viscosity reducing effect, and (3) varying particle size or physical form of formulation components. Controlling temperature is the preferred method of producing the desired viscosity.

Since higher complex phosphate is subject to reversion to pyro- or orthophosphate in a fluid, aqueous, highly alkaline environment at elevated temperatures, it is also important in certain embodiments to add last and quickly cool the molten detergent suspension to a temperature at which it will solidify at a sufficiently rapid rate to reduce or prevent reversion, yet at which the desired stratification process will occur.

Appropriate temperature ranges for providing stratification and reducing reversion will be dictated by the nature of the components and the relative amounts in which they are found in any given composition. For a given composition formulation, an appropriate temperature, if necessary, can be determined by trial and error; the formulation can be mixed, maintained at various temperatures, cooled and then examined to determine whether the degree of stratification and reversion is within the desired parameters. Temperatures of from about 135° F. to about 168° F. have been found to produce stratification without significant reversion in typical formulations. Temperatures of from about 148° F. to about 163° F. provide particularly desirable results. Temperatures above about 170° F. have been found to produce significant reversion in many formulations; however, such temperatures can be used for a particular formulation if the desired stratification and reduced reversion characteristics are produced. Extended mixing time at elevated temperatures can increase component degradation. In compositions having lower active alkalinity content (such as for example, those containing about 5% to about 25% average active alkalinity), the temperature range useful for providing the desired stratification effect may be lowered, even to as low as about 115° F.

The compositions of the present invention can include any of the components typically found in alkaline warewashing compositions. For example, any source of active alkalinity can be used to provide the desired alkalinity to the compositions. The alkali component of appropriate formulations is typically provided by an alkali metal hydroxide, such as sodium or potassium hydroxide. The alkali metal hydroxide can be used in any available liquid or solid form, although solid form is preferred. If solid metal hydroxide is used, any particle size can be used; however, commercially available beads (pellets) of medium size have been found to provide desirable results. Particularly, dissolving of metal hydroxide pellets is an exothermic process which can be harnessed to elevate the temperature of the resulting molten detergent suspension. Adjusting the particle size of the metal hydroxide may also contribute to adjustment of the viscosity of the molten detergent suspension. 0.75 mm sodium hydroxide pellets (bulk density 1,150 kg/m$^3$ or about 73 lb./ft$^3$) have been found to provide desirable results. Alkali metal silicates, such as anhydrous sodium metasilicate, can also be used as an active alkalinity source to replace some or all of the metal hydroxide. In larger bead or granular form, sodium hydroxide and/or alkaline silicate (such as for example anhydrous metasilicate) may be used as stratified components.

The compositions can also contain a source of available halogen. Any organic or inorganic material which provides active halogen, particularly chlorine (such as in the form of hypochlorite or $Cl_2$), can be used. Examples of appropriate chlorine sources include alkali metal and alkali earth metal hypochlorite, hypochlorite addition products, chloramines, chlorimines, chloramides, and chlorimides. Compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate, sodium dichloroisocyanurate dihydrate, 1,3-dichloro-5,5-dimethylhydantoin, N-chlorosulfamide, Chloramine T, Dichloramine T, Chloramine B and Dichloramine B. Stability is maximized when these materials are used in granular form and added last before the component(s) to be stratified. Encapsulated chlorine sources may also be used to provide better in-processing and storage stability.

The compositions may also contain surfactants, including nonionic surfactants, anionic surfactants, amphoteric surfactants and cationic surfactants. Preferred materials for machine spray washing application are those nonionic surfactants with defoaming characteristics (such as those sold under the "Triton CF" series by Union Carbide). Preferred surfactants include alkali metal alkyl benzene sulfonates, alkali metal alkyl sulfates, and mixtures thereof. Nonionic surfactants can also be used alone or in combination with anionic, amphoteric or cationic surfactants. Suitable nonionic surfactants include polyethylene condensates of alkyl phenols, products derived from the condensation of ethylene oxide with the reaction product of propylene oxide and ethylene diamine, the condensation product of aliphatic fatty alcohols with ethylene oxide as well as amine oxides and phosphine oxides. Products sold under the tradename "Pluronic" provide desirable results.

The compositions of the present invention may contain a supplemental water conditioning agent to enhance performance by sequestering calcium and/or magnesium ions at lower phosphate levels or to replace phosphate where its presence is undesirable. These include organic chelating/sequestering agents (such as gluconates, citrates, glucoheptanates, phosphonates, EDTA, nitrilo triacetate (NTA), polyacrylic acid of molecular weight of about 1,000–4,000 or greater in the useful range of sequestrants alone with copolymers and blends of the acrylic/maleic or other forms. These materials may be incorporated at any useful level from less than 1% to more than 15%. In addition, the compositions of the invention may contain any functional defoamer which may or may not have surface active properties.

The compositions of the invention can be made by combining the components of the formulation in suitable mixing equipment. Preferably, any source of complex phosphate is added last to reduce the time in which the material is exposed to elevated temperatures. As mixing occurs the temperature of the detergent suspension is adjusted to the desired range. In formulations employing solid metal hydroxide as an active alkalinity source, dissolution of the metal hydroxide is exothermic and generates heat, Minimal heat is required to be supplied from external sources. When liquid alkali metal hydroxide or other source of active alkalinity are used heat may need to be supplied. Heat may be applied by usual means, such as a steam-heated mixer jacket. The temperature of the detergent suspension may also be cooled, if necessary, to provide the desired temperature. Any known cooling means can be used, including a water-cooled mixer jacket. When the detergent suspension has reached the desired temperature, the molten suspension is poured into a mold (such as a disposable container) where it is allowed to cool. Formation of a stable hydrate by the water of hydration in the alkali material causes the molten suspension to form a solidified mass.

The following examples demonstrate certain preferred embodiments of the compositions and methods of the present invention.

EXAMPLE 1

300 g samples were prepared according to the following formulations:

| sample | I | II | III | IV |
|---|---|---|---|---|
| water | 26.3 (wt %) | 24.8 | 23.25 | 21.7 |
| sodium hydroxide (solid) | 58.7 | 55.2 | 51.75 | 48.3 |
| STPP (dense granular) | 15.0 | 20.0 | 25.0 | 30.0 |

The samples were prepared by adding the required amount of water to a beaker, followed by the addition of bead (pelletized) sodium hydroxide with mixing. The hydration reaction of the sodium hydroxide was exothermic and the solution was continually mixed as the sodium hydroxide dissolved. The temperature was then adjusted to 150° F. The required amount of dense granular sodium tripolyphosphate (density: 62 lb./ft$^3$; particle size: >95% on 100 mesh (U.S.) and >75% on 0.5 mm (metric)) was then added quickly and mixed for approximately one minute. The temperature was then verified to be just below 150°. The molten detergent suspension was then poured into an eight ounce straight sided cylindrical bottle with a thirty eight millimeter cap, the dimensions of the cylindrical portion of the bottle being approximately five and one quarter inches high by approximately two inches in diameter. The portion of the three hundred gram sample which was poured into the bottle and did not adhere to the beaker occupied approximately three and one half inches of vertical height of the bottle. The samples were then capped as they were made and immersed to a depth of approximately four and one half inches in a large sink of tap water at approximately 58°. The samples solidified relatively quickly and were allowed to remain in the water to cool to room temperature.

After approximately two hours, the physical appearance of the samples was observed in front of a bright light. Each sample showed marked stratification to the naked eye. The appearance of stratification was visibly noticeable based upon the fact that the top portion of the samples was extremely uniform and almost translucent while the lower portion of the stratified material showed the granular texture of the sodium tripolyphosphate being evident and opaque in appearance. This opaque area, which showed as a dark shadow in front of a bright light, appeared to represent the highly stratified portion of the sample. Its height in the container varied from a little over one inch for the sample containing fifteen percent sodium tripolyphosphate to nearly two inches for the sample containing thirty percent sodium tripolyphosphate.

EXAMPLE 2

Samples were prepared including sodium metasilicate and sodium carbonate according to the following formulations:

| | A | B | C | D | E | F |
|---|---|---|---|---|---|---|
| water | 23.25 (wt %) | 23.25 | 23.25 | 23.25 | 23.25 | 23.25 |
| sodium hydroxide (bead) | 51.75 | 51.75 | 51.75 | 51.75 | 51.75 | 51.75 |
| STPP (dense granular) | 20.0 | 20.0 | 20.0 | 5.0 | 5.0 | 10.0 |
| anhydrous sodium metasilicate | 5.0 | — | — | — | — | — |
| sodium carbonate (light soda ash) | — | 5.0 | — | — | 5.0 | 15.0 |
| sodium carbonate (dense soda ash) | — | — | 5.0 | — | — | — |
| sodium hydroxide (bead) | — | — | — | 20.0 | 15.0 | — |

The components were mixed as described above, with the second listed portion of sodium hydroxide being added last. Samples A–E showed visible stratification. Stratification of sample F was not apparent to the naked eye, but a chemical analysis of the sample was not performed to determine the degree of stratification.

EXAMPLE 3

Samples were made incorporating organic water-conditioning materials according to the following formulations:

| | A | B | C | D | E | F | G | H |
|---|---|---|---|---|---|---|---|---|
| water | 23.25 | 23.25 | 23.25 | 23.25 | 23.25 | 23.25 | 23.25 | 23.25 |
| sodium hydroxide (bead) | 51.75 | 51.75 | 51.75 | 51.75 | 51.75 | 51.75 | 51.75 | 51.75 |
| STPP (dense granular) | 20.0 | 20.0 | 20.0 | 20.0 | 20.0 | 20.0 | 20.0 | 20.0 |
| polyacrylic acid (4500 MW) | 5.0 | — | — | — | — | — | — | — |
| acrylic maleic copolymer (SoKolan CP5) | — | 5.0 | — | — | — | — | — | — |
| citric acid | — | — | 5.0 | — | — | — | — | — |
| gluconic acid (50%) | — | — | — | 5.0 | — | — | — | — |
| sodium glucoheptanate | — | — | — | — | 5.0 | — | — | — |
| trisodium nitrilo triacetate | — | — | — | — | — | 5.0 | — | — |
| tetrasodium EDTA | — | — | — | — | — | — | 5.0 | — |
| phosphonate (Dequest 2000) | — | — | — | — | — | — | — | 5.0 |

The inclusion of these additives did not appear to appreciably change the stratification characteristics on a visible basis seen in prior samples without the additives.

EXAMPLE 4

Samples were made including surfactants and defoamers to the following formulations:

| | A | B | C | D | E | F |
|---|---|---|---|---|---|---|
| water | 23.25 | 23.25 | 23.25 | 23.25 | 23.25 | 23.25 |
| sodium hydroxide (bead) | 51.75 | 51.75 | 51.75 | 51.75 | 51.75 | 51.75 |
| STPP (dense granular) | 20.0 | 20.0 | 20.0 | 20.0 | 20.0 | 20.0 |
| polyacrylic acid (4500 MW) | 5.0 | 3.0 | 3.0 | 3.5 | 3.5 | 4.0 |
| nonylphenol ethoxylate (N-95) | — | — | — | 1.5 | — | — |
| ethylene oxide-propylene oxide (Pluronic L) | — | — | — | — | 1.5 | — |
| modified aryl aloxylate (Triton CF) | — | — | — | — | — | 1.0 |
| dodecyl benzene sulfonic acid (anionic) | 2.0 | — | — | — | — | — |
| Miranol JEM (amphoteric) | — | 2.0 | — | — | — | — |

-continued

| | A | B | C | D | E | F |
|---|---|---|---|---|---|---|
| BTC 2125M (quaternary aryl) | — | — | 2.0 | — | — | — |

The inclusion of these additives did not visibly affect the observed stratification.

EXAMPLE 5

A production-sized batch (1000 lbs.) of the following formulation was made:

| | |
|---|---|
| NaOH (50% soln.) | 427 lbs. |
| sodium carbonate (light soda ash) | 30 |
| polyacrylic acid (MW 4500) | 60 |
| NaOH (solid) | 260 |
| Triton CF76 | 8 |
| antifoam | 1.5 |
| sodium glucoheptanate | 15 |
| STPP (dense granular) | 200 |

The batch was made according to the general steps described in Example 1. In this batch, the temperature was adjusted to 153°–158° F. before dumping the suspension out of the kettle.

Figure 4:
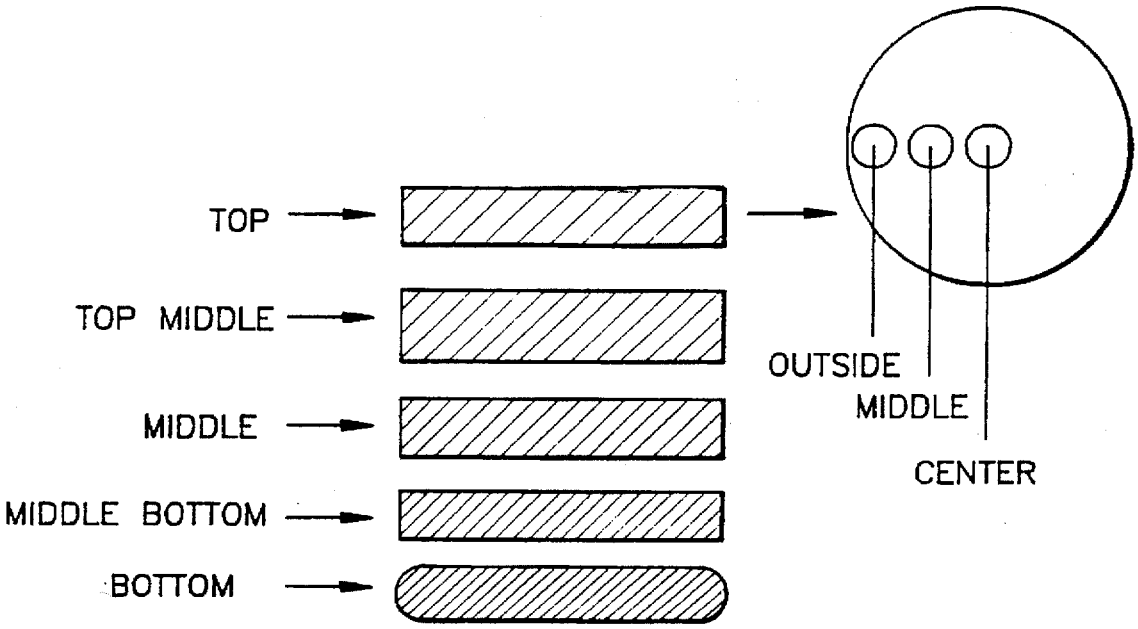
FIG. 4 depicts a method for sampling a composition of the present invention for chemical analysis to determine the amount of stratification.

Finished samples were taken from this batch for chemical analysis. 127 8-pound jars (approximate weight) were produced in this batch. The 29th (early stage), 67th (intermediate stage) and 111th (late stage) jars were taken as samples for analysis. Each jar was sliced into five slices designated top, top-middle, middle, middle-bottom and bottom (see FIG. 4). Cores were then taken from each slice at center, middle and outside positions (see FIG. 4). Each core was then analyzed for total $Na_2O$ active $Na_2O$, % orthophosphate, and % total $P_2O_5$. % NaOH and % STPP were calculated from analytical values.

The results of the analysis are reported in the following table. "C", "M" and "O' denote center middle and outside core samples.

The data show that the composition is stratified (i.e., non-uniform) from top to bottom within the jar with respect to each of the parameters tested. Of particular interest is the variation of the active $Na_2O$ and STPP. Using an average of the figures reported for the center, middle and outside samples in each top and bottom layer, active $Na_2O$ varies from top to bottom by 33.5% at early stages of production, by 22.8% at intermediate stages and by 35.3% at late stages. STPP varies from bottom to top by 87.2% at early stages of production, by 84.8% at intermediate stages and by 79.9% at late stages. Thus, the analytical data demonstrate that there is a broad range of variation of active $Na_2O$ and STPP in the stratified product.

EXAMPLE 6

Figure 5:
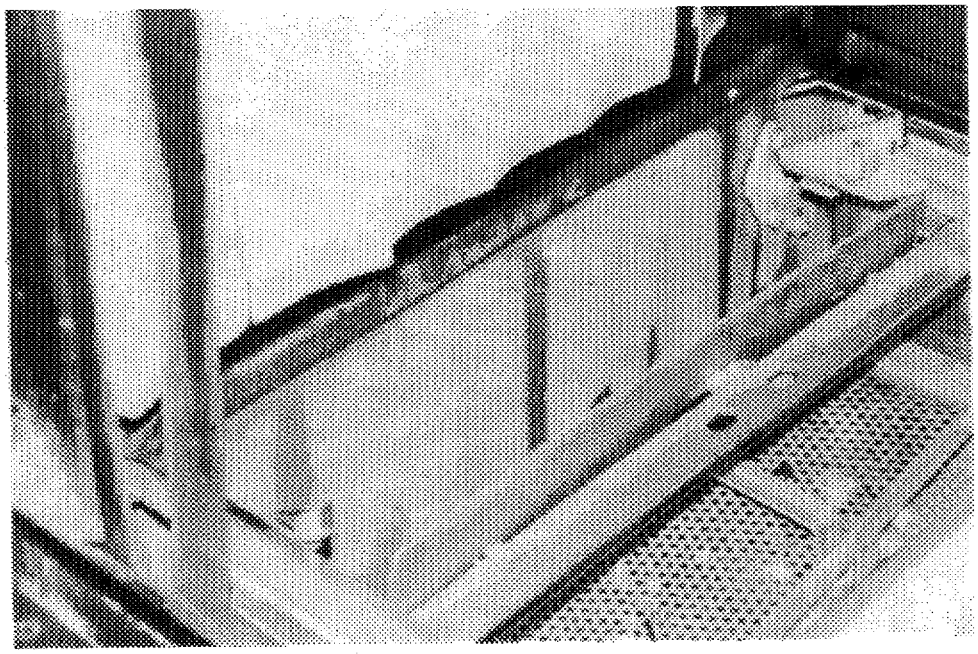
FIG. 5 is a photograph of the interior of a commercial ware washing machine which had used a prior art solid uniformly cast alkaline detergent composition.

Jars produced in Example 5 were tested in a commercial washing machine. FIG. 5 shows the condition of the washing machine after it had been routinely using a prior art high alkalinity solid cast ware washing detergent of the following formulation:

| | |
|---|---|
| water | 14.5 (wt %) |
| NaOH (bead) | 48.5 |
| sodium carbonate (light soda ash) | 17.35 |
| polyacrylic acid (MW 4500) | 4.26 |
| tetrasodium EDTA | 4.26 |
| STPP (light) | 10.41 |
| surfactant (CF-76)/ defoamer | 0.61 |

Figure 6:
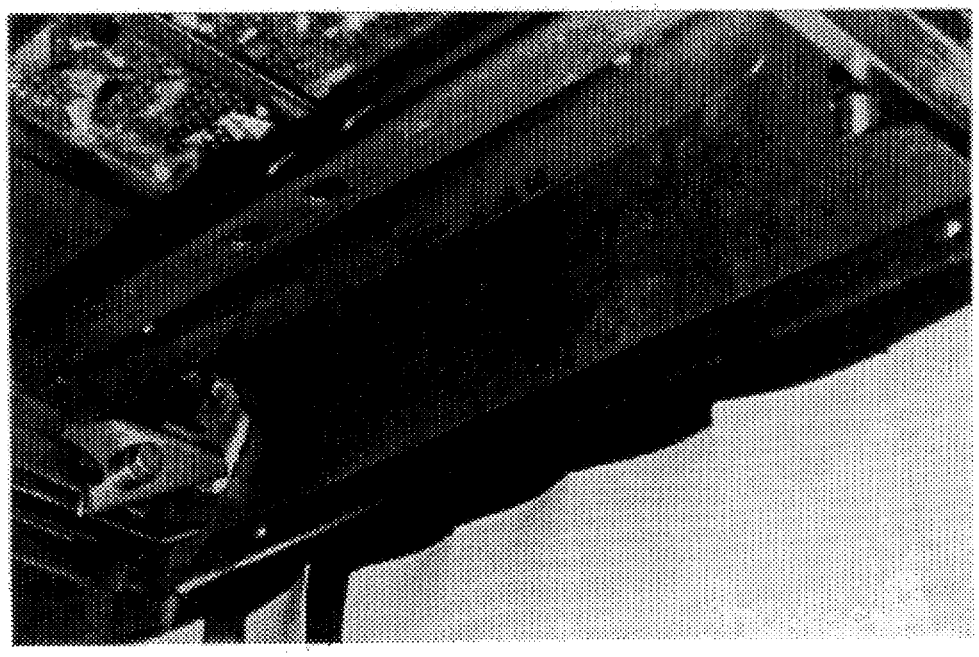
FIG. 6 is a photograph of the interior of the same machine after use of a preferred composition of the present invention.

This prior art product was uniformly cast. Heavy lime deposits and scaling can be seen on the vertical wall of the machine. A photograph was taken of the wash tank (FIG. 6) when use of the prior art product was discontinued before changeover. Use of the product was discontinued by removing the partial jar from the dispenser and replacing it with the composition of Example 5. No adjustment was made to any control devices or operating conditions or methods. No acid descaling or special steps were taken other than use of the composition of Example 5.

Normal washing procedures of the customer were followed using jars of the composition of the present invention

| Sampling | Sample | % Total | | | % Active | | | % NaOH | | | % Orthophosphate | | | % Total | | | % STPP | | |
|---|---|---|---|---|---|---|---|---|---|---|---|---|---|---|---|---|---|---|---|
| Time | Layer | C | M | O | C | M | O | C | M | O | C | M | O | C | M | O | C | M | O |
| Early | top | 44.1 | 45.5 | 45.2 | 41.7 | 43.3 | 42.8 | 57.4 | 58.4 | 58.5 | 0.85 | 0.81 | 0.62 | 1.9 | 4.00 | 2.50 | 1.82 | 5.55 | 3.27 |
| | top-middle | 44.4 | 44.3 | 43.5 | 40.5 | 40.5 | 40.0 | 56.6 | 56.8 | 55.6 | 0.90 | 0.92 | 0.93 | 4.8 | 4.22 | 4.10 | 6.79 | 5.74 | 5.52 |
| | middle | 41.9 | 43.6 | 44.4 | 36.9 | 39.6 | 40.4 | 52.3 | 54.1 | 56.3 | 1.34 | 1.58 | 1.47 | 7.43 | 8.80 | 5.54 | 10.6 | 12.5 | 7.08 |
| | mid-bottom | 39.7 | 40.8 | 40.0 | 33.4 | 35.1 | 34.0 | 47.1 | 47.4 | 47.0 | 3.00 | 2.54 | 2.45 | 13.5 | 16.6 | 14.7 | 18.3 | 24.4 | 21.3 |
| | bottom | 36.4 | 37.7 | 34.5 | 28.5 | 30.2 | 26.4 | 40.9 | 42.0 | 38.3 | 3.00 | 3.00 | 2.90 | 18.3 | 20.0 | 18.6 | 26.6 | 29.7 | 27.3 |
| Intermediate | top | 46.1 | 44.8 | 44.9 | 43.4 | 41.7 | 42.4 | 59.9 | 57.9 | 58.1 | 1.00 | 0.94 | 1.00 | 2.10 | 3.00 | 2.50 | 1.91 | 3.58 | 2.61 |
| | top-mid | 43.3 | 44.5 | 43.5 | 39.3 | 39.4 | 40.1 | 55.0 | 56.6 | 55.1 | 1.57 | 1.20 | 1.40 | 5.32 | 5.00 | 5.53 | 6.53 | 6.61 | 7.19 |
| | middle | 42.3 | 42.2 | 41.3 | 37.2 | 37.8 | 37.1 | 52.9 | 51.8 | 0.94 | 1.27 | 1.40 | 7.30 | 6.91 | 6390 | 11.0 | 9.82 | 9.57 | |
| | mid-bottom | 40.1 | 39.0 | 40.8 | 33.8 | 32.2 | 34.8 | 46.9 | 46.8 | 45.7 | 2.34 | 2.57 | 2.27 | 15.2 | 11.9 | 13.4 | 22.3 | 16.2 | 19.3 |
| | bottom | 38.3 | 34.4 | 52.4 | 31.9 | 25.7 | 40.8 | 42.8 | 44.0 | 62.6 | 3.00 | 2.89 | 3.25 | 19.9 | 3.34 | 16.7 | 29.4 | 0.78 | 23.5 |
| Late | top | 46.7 | 44.2 | 46.0 | 43.7 | 40.5 | 42.3 | 59.5 | 56.3 | 59.5 | 1.30 | 1.00 | 0.64 | 5.30 | 4.80 | 2.66 | 6.96 | 6.61 | 3.51 |
| | top-mid | 43.8 | 42.9 | 43.6 | 39.7 | 39.2 | 39.9 | 55.3 | 54.2 | 55.6 | 1.51 | 1.50 | 1.20 | 5.94 | 6.00 | 4.70 | 7.71 | 7.83 | 6.09 |
| | middle | 40.3 | 42.3 | 41.6 | 35.2 | 37.5 | 36.5 | 49.7 | 53.0 | 52.4 | 1.92 | 1.56 | 1.50 | 8.80 | 7.10 | 6.35 | 11.9 | 9.64 | 8.44 |
| | mid-bottom | 38.0 | 37.1 | 38.1 | 31.0 | 30.1 | 31.2 | 43.9 | 43.5 | 45.3 | 2.60 | 2.32 | 2.45 | 15.9 | 14.30 | 12.8 | 23.1 | 20.3 | 18.0 |
| | bottom | 35.1 | 34.0 | 36.7 | 27.6 | 24.2 | 30.0 | 38.6 | 37.6 | 60.8 | 3.33 | 3.10 | 3.14 | 20.0 | 18.8 | 19.8 | 29.0 | 27.3 | 28.9 |

madein Example 5. Near the end of the fourth jar of composition a second photograph was taken (see FIG. 6). This photograph shows that the heavy lime deposits and scaling have been removed as a result of the boost in phosphate content provided by the composition of the present invention. This cleaning result was achieved solely by use of the composition of the present invention in the normal course of operation of the machine. No down time was required. Dishes and glasses run through the machine after conversion to the composition of the present invention were examined and found to be spot free and had a bright, renewed appearance.

EXAMPLE 7

The effect of incorporation of other typical desirable detergent builders and components in the near monohydrate ratio sodium hydroxide solution was examined. Granular anhydrous sodium metasilicate was used in a formulation as follows:

| | |
|---|---|
| NaOH (50% wt soln.) | 130 (gms) |
| sodium carbonate (dense soda ash) | 24 |
| LMW45 (polyacrylate) | 18.2 |
| NaOH (solid bead) | 75 |
| sodium glucoheptanate | 6 |
| CF76 (surfactant) | 1.5 |
| antifoam | 0.3 |
| anhydrous sodium metasilicate | 45 |

This sample was prepared in the same manner described in Example 5, with the metasilicate being added in place of the STPP. This composition stratified in a manner similar to those described previously.

What is claimed is:

1. A stratified, heterogeneous, substantially non-uniform, solid cast alkaline detergent composition comprising the following components (a)–(c):

(a) an active alkalinity source sufficient to provide an average alkalinity content of about 5% to about 65% by weight throughout said composition, (b) a granular inorganic water conditioning material sufficient to maintain detergency and threshold water conditioning effect even where minimal conditioner concentrations are present, and (c) water of hydration sufficient to solidify said composition, wherein the amounts of components (a) and (b) vary continuously in concentration from the inner to the outer regions of said composition, and wherein such variation in concentration is produced by cooling to solidification an aqueous suspension comprising components (a)–(c) so that components (a) and (b) will stratify upon solidification to yield said stratified, heterogeneous, substantially non-uniform, solid cast alkaline detergent composition.

2. The composition of claim 1 wherein said water conditioning material comprises a complex phosphate.

3. The composition of claim 2 wherein said composition contains an average concentration throughout said composition of less than about 50% orthophosphate as a result of reversion of said complex phosphate.

4. The composition of claim 3 wherein less than about 40% of said complex phosphate has reverted to orthophosphate.

5. The composition of claim 4 wherein less than about 20% of said complex phosphate has reverted to orthophosphate.

6. The composition of claim 5 wherein less than about 10% of said complex phosphate has reverted to orthophosphate.

7. The composition of claim 2 wherein said complex phosphate is selected from the group consisting of sodium tripolyphosphate, tetrasodium pyrophosphate, sodium hexametaphosphate, sodium trimetaphosphate, potassium tripolyphosphate, tetrapotassium pyrophosphate, potassium hexametaphosphate, and potassium trimetaphosphate.

8. The composition of claim 7 wherein said complex phosphate comprises an alkali metal tripolyphosphate.

9. The composition of claim 8 wherein said alkali metal tripolyphosphate is sodium tripolyphosphate.

10. The composition of claim 8 wherein said complex phosphate further comprises a second phosphate material.

11. The composition of claim 2, wherein there is an increased concentration of complex phosphate, or decreased concentration of active alkalinity source, in the portion of said composition to be used last.

12. The composition of claim 1, wherein the composition releases an increased amount of said complex phosphate as said composition is consumed during use in a washing machine such that the portion of said composition which is used last is sufficient to dissolve scale and lime accumulation in said washing machine.

13. The composition of claim 1 wherein said active alkalinity source is selected from the group consisting of an alkali metal hydroxide, an alkali metal carbonate and an alkali metal silicate.

14. The composition of claim 13 wherein said active alkalinity source comprises an alkali metal hydroxide.

15. The composition of claim 14 wherein said alkali metal hydroxide is selected from the group consisting of sodium hydroxide and potassium hydroxide.

16. The composition of claim 15 wherein said alkali metal hydroxide is sodium hydroxide.

17. The composition of claim 13 wherein said active alkalinity source comprises an alkali metal silicate.

18. The composition of claim 17 wherein said alkali metal silicate is sodium metasilicate.

19. The composition of claim 14 wherein said active alkalinity source further comprises an alkali metal carbonate.

20. The composition of claim 19 wherein said alkali metal carbonate is sodium carbonate.

21. The composition of claim 14 wherein said active alkalinity source further comprises an alkali metal silicate.

22. The composition of claim 21 wherein said alkali metal silicate is sodium metasilicate.

23. The composition of claim 1 wherein said active alkalinity source provides an average active alkalinity content of about 10% to about 50%.

24. The composition of claim 23 wherein said active alkalinity source provides an average active alkalinity content of about 25% to about 50%.

25. The composition of claim 23 wherein said active alkalinity source provides an average active alkalinity content of about 5% to about 25%.

26. The composition of claim 1 wherein said composition is cast to provide a stratified composition in a container from which the composition is used for washing.

27. The composition of claim 26 wherein said container is disposable container.

28. A stratified, heterogeneous, substantially non-uniform, solid cast alkaline detergent composition comprising the following components (a)–(c):

(a) an active alkalinity source sufficient to provide an average alkalinity content of about 5% to about 65% by weight throughout said composition, (b) a granular detergent component sufficient to maintain detergency, and (c) water of hydration sufficient to solidify said composition, wherein the amount of component (b) varies continuously in concentration from the inner to the outer regions of said composition, and wherein such variation in concentration is produced by cooling to solidification an aqueous suspension comprising components (a)–(c) so that component (b) will stratify upon solidification to yield said stratified, heterogeneous, substantially non-uniform, solid cast alkaline detergent composition.

* * * * *

UNITED STATES PATENT AND TRADEMARK OFFICE

CERTIFICATE OF CORRECTION

PATENT NO. : 5,670,467

DATED : September 23. 1997

INVENTOR(S) : Howard Fleisher

It is certified that error appears in the above-identified patent and that said Letters Patent is hereby corrected as shown below:

Columns, 11 and 12, the table spanning both columns at the bottom should read:

Signed and Sealed this

Third Day of March, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,670,467

DATED : September 23. 1997

INVENTOR(S) : Howard Fleisher

It is certified that error appears in the above-identified patent and that said Letters Patent is hereby corrected as shown below:

| Sampling Time | Sample Layer | % Total $Na_2O$ | | | % Active $Na_2O$ | | | % NaOH | | | % Ortho-phosphate | | | % Total $P_2O_5$ | | | % STPP | | |
|---|---|---|---|---|---|---|---|---|---|---|---|---|---|---|---|---|---|---|---|
| | | C | M | O | C | M | O | C | M | O | C | M | O | C | M | O | C | M | O |
| Early | top | 44.1 | 45.5 | 45.2 | 41.7 | 43.3 | 42.8 | 57.4 | 58.4 | 58.5 | 0.85 | 0.81 | 0.62 | 1.9 | 4.00 | 2.50 | 1.82 | 5.55 | 3.27 |
| | top-middle | 44.4 | 44.3 | 43.5 | 40.5 | 40.5 | 40.0 | 56.6 | 56.8 | 55.6 | 0.90 | 0.92 | 0.93 | 4.8 | 4.22 | 4.10 | 6.79 | 5.74 | 5.52 |
| | middle | 41.9 | 43.6 | 44.4 | 36.9 | 39.6 | 40.4 | 52.3 | 54.1 | 56.3 | 1.34 | 1.58 | 1.47 | 7.43 | 8.80 | 5.54 | 10.6 | 12.5 | 7.08 |
| | mid-bottom | 39.7 | 40.8 | 40.0 | 33.4 | 35.1 | 34.0 | 47.1 | 47.4 | 47.0 | 3.00 | 2.54 | 2.45 | 13.5 | 16.6 | 14.7 | 18.3 | 24.4 | 21.3 |
| | bottom | 36.4 | 37.7 | 34.5 | 28.5 | 30.2 | 26.4 | 40.9 | 42.0 | 38.3 | 3.00 | 3.00 | 2.90 | 18.3 | 20.0 | 18.6 | 26.6 | 29.7 | 27.3 |
| Inter-mediate | top | 46.1 | 44.8 | 44.9 | 43.4 | 41.7 | 42.4 | 59.9 | 57.9 | 58.1 | 1.00 | 0.94 | 1.00 | 2.10 | 3.00 | 2.50 | 1.91 | 3.58 | 2.61 |
| | top-mid | 43.3 | 44.5 | 43.5 | 39.3 | 39.4 | 40.1 | 55.0 | 56.6 | 55.1 | 1.57 | 1.20 | 1.40 | 5.32 | 5.00 | 5.53 | 6.53 | 6.61 | 7.19 |
| | middle | 42.3 | 42.2 | 41.3 | 37.2 | 37.8 | 37.1 | 52.9 | 52.9 | 51.8 | 0.94 | 1.27 | 1.40 | 7.30 | 6.91 | 6.90 | 11.0 | 9.82 | 9.57 |
| | mid-bottom | 40.1 | 39.0 | 40.8 | 33.8 | 32.2 | 34.8 | 46.9 | 46.8 | 45.7 | 2.34 | 2.57 | 2.27 | 15.2 | 11.9 | 13.4 | 22.3 | 16.2 | 19.3 |
| | bottom | 38.3 | 34.4 | 52.4 | 31.9 | 25.7 | 40.8 | 42.8 | 44.0 | 62.6 | 3.00 | 2.89 | 3.25 | 19.9 | 3.34 | 16.7 | 29.4 | 0.78 | 23.5 |
| Late | top | 46.7 | 44.2 | 46.0 | 43.7 | 40.5 | 42.3 | 59.5 | 56.3 | 59.5 | 1.30 | 1.00 | 0.64 | 5.30 | 4.80 | 2.66 | 6.96 | 6.61 | 3.51 |
| | top-mid | 43.8 | 42.9 | 43.6 | 39.7 | 39.2 | 39.9 | 55.3 | 54.2 | 55.6 | 1.51 | 1.50 | 1.20 | 5.94 | 6.00 | 4.70 | 7.71 | 7.83 | 6.09 |
| | middle | 40.3 | 42.3 | 41.6 | 35.2 | 37.5 | 36.5 | 49.7 | 53.0 | 52.4 | 1.92 | 1.56 | 1.50 | 8.80 | 7.10 | 6.35 | 11.9 | 9.64 | 8.44 |
| | mid-bottom | 38.0 | 37.1 | 38.1 | 31.0 | 30.1 | 31.2 | 43.9 | 43.5 | 45.3 | 2.60 | 2.32 | 2.45 | 15.9 | 14.0 | 12.8 | 23.1 | 20.3 | 18.0 |
| | bottom | 35.1 | 34.0 | 36.7 | 27.6 | 24.2 | 30.0 | 38.6 | 37.6 | 40.8 | 3.33 | 3.10 | 3.14 | 20.0 | 18.8 | 19.8 | 29.0 | 27.3 | 28.9 |